US007789255B2

(12) United States Patent
Zoppas

(10) Patent No.: US 7,789,255 B2
(45) Date of Patent: Sep. 7, 2010

(54) PLASTIC BOTTLE BASE

(75) Inventor: Enrico Zoppas, Conegliano (IT)

(73) Assignee: Acqua Minerale S. Benedetto - S.p.A., Scorze' (IT)

( * ) Notice: Subject to any disclaimer, the term of this patent is extended or adjusted under 35 U.S.C. 154(b) by 141 days.

(21) Appl. No.: 11/791,959

(22) PCT Filed: Dec. 21, 2005

(86) PCT No.: PCT/IB2005/003832

§ 371 (c)(1),
(2), (4) Date: May 31, 2007

(87) PCT Pub. No.: WO2006/067590

PCT Pub. Date: Jun. 29, 2006

(65) Prior Publication Data

US 2007/0262046 A1 Nov. 15, 2007

(30) Foreign Application Priority Data

Dec. 24, 2004 (IT) ..... PD04A0323

(51) Int. Cl.
*B65D 1/02* (2006.01)
*B65D 23/00* (2006.01)

(52) U.S. Cl. ..... 215/375; 220/606

(58) Field of Classification Search ..... 215/373–375; 220/606–609, 675

See application file for complete search history.

(56) References Cited

U.S. PATENT DOCUMENTS

| | | | | | |
|---|---|---|---|---|---|
| 2,641,374 | A | * | 6/1953 | Der Yuen | 215/10 |
| 3,270,922 | A | * | 9/1966 | Schmidt | 222/143 |
| 3,948,404 | A | | 4/1976 | Collins et al. | |
| 4,978,015 | A | * | 12/1990 | Walker | 215/375 |
| 5,427,258 | A | * | 6/1995 | Krishnakumar et al. | 215/400 |
| 5,549,210 | A | * | 8/1996 | Cheng | 215/375 |
| D414,420 | S | * | 9/1999 | Zogg | D9/520 |
| 6,112,925 | A | * | 9/2000 | Nahill et al. | 215/382 |
| 6,536,619 | B2 | * | 3/2003 | Gaydosh et al. | 215/375 |
| 6,588,612 | B1 | * | 7/2003 | Dorn et al. | 215/10 |
| 6,889,858 | B2 | * | 5/2005 | McCollum et al. | 215/382 |
| 7,055,711 | B2 | * | 6/2006 | Sasaki et al. | 215/373 |
| 2004/0094502 | A1 | * | 5/2004 | Boukobza | 215/375 |

FOREIGN PATENT DOCUMENTS

| | | | |
|---|---|---|---|
| FR | 2 753 435 | A | 3/1998 |
| RU | 52766 | S | 10/2001 |
| WO | WO 00/07886 | * | 2/2000 |

* cited by examiner

*Primary Examiner*—Sue A Weaver
(74) *Attorney, Agent, or Firm*—Modiano & Associati; Albert Josif; Daniel J. O'Byrne

(57) ABSTRACT

A bottle base made of plastic material, particularly for beverages, of the type which has, on its bottom, reinforcement recesses. The reinforcement recesses comprise a recess which runs along a transverse reference dimension of the base; the recess forms a main rib inside the base.

19 Claims, 10 Drawing Sheets

PLASTIC BOTTLE BASE

The present invention relates to a plastic bottle base particularly for beverages.

BACKGROUND OF THE INVENTION

Plastic bottles adapted to contain beverages and liquids in general, even under pressure, are currently known and widespread.

Such bottles are those which, for example, contain carbonated beverages or just slightly sparkling beverages, but also those which contain still but nitrogen-capped beverages, i.e., beverages in the bottle of which nitrogen is introduced in order to stiffen the bottle as a whole so as to facilitate its storage.

The base of such a bottle has, on its bottom, a plurality of recesses adapted to form protrusions which allow it to stand and at the same time stiffen said bottom, so that it can better withstand both the internal pressure of the bottle and the weight of any overlying bottles during stocking or storage.

The bottom of such a bottle is generally designated by the term "petaloid" due to the resemblance of its plan shape to the stylized outline of a flower.

Bottles with a petaloid bottom, although they are highly appreciated and easily available in everyday life substantially in all food stores, can be scarcely stable when standing or can tip easily when considered individually.

This instability increases as the geometry of the petaloid places the standing contact regions closer to the center of the bottom.

SUMMARY OF THE INVENTION

The aim of the present invention is to provide a bottle base capable of solving the drawbacks exhibited by known bases and to improve the standing stability of the bottle to which it belongs.

Within this aim, an object of the present invention is to provide a bottle base whose aesthetic impact is at least equal to that of known types of base.

Another object of the present invention is to provide a bottle base which is capable of withstanding the forces imparted by overlying bottles during storage no less than known bottle bases.

Another object of the present invention is to provide a bottle base which can be obtained easily and cheaply by molding plastic material.

Another object of the present invention is to provide a bottle base which can withstand internal pressures up to one bar.

Another object of the present invention is to provide a bottle base which can be manufactured with known systems and technologies.

This aim and these and other objects, which will become better apparent hereinafter, are achieved by a bottle base made of plastic material, particularly for beverages, of the type which has, on its bottom, reinforcement recesses, characterized in that said reinforcement recesses are formed by a recess which runs along a transverse reference dimension of said base, said recess being suitable to form a main rib inside the base.

Advantageously, the bottle base comprises an additional recess, which runs along a second transverse reference dimension, which is substantially perpendicular to the transverse dimension along which said main rib lies, said additional recess being suitable to form a second auxiliary rib, the distance between the supporting surface and the at least one lowest point of the first rib being greater than the distance between the at least one lowest point of said second rib and said supporting surface.

BRIEF DESCRIPTION OF THE DRAWINGS

Further characteristics and advantages of the invention will become better apparent from the following detailed description of two preferred but not exclusive embodiments thereof, illustrated by way of non-limiting example in the accompanying drawings, wherein.

DESCRIPTION OF THE PREFERRED EMBODIMENTS

Figure 1:
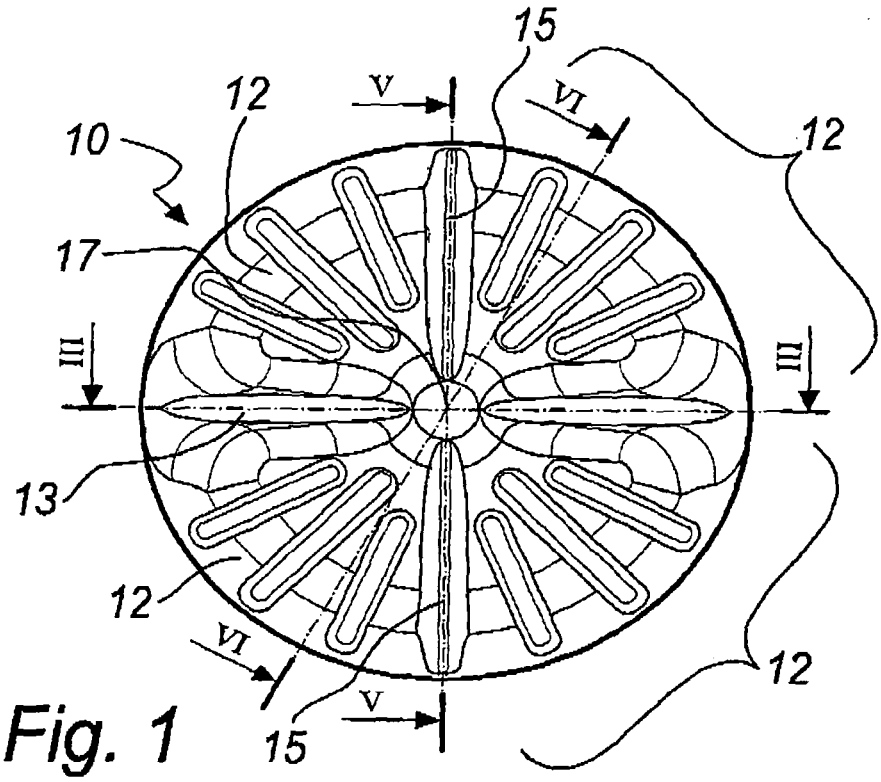
FIG. 1 is a bottom view of a base according to the invention, in a first embodiment.

With reference to the figures, a bottle base made of plastics, particularly for beverages, according to the invention, is generally designated by the reference numeral 10 in its first embodiment.

The plastic bottle base 10, in its first embodiment, has a circular transverse cross-section.

The base 10 has, on a bottom 11, a first recess 13, which lies along a first transverse reference dimension of the base 10.

Said first transverse reference dimension is therefore a first diameter.

The first recess 13 is adapted to form, inside the base 10, a first main rib 14, the top profile of which forms a substantially U-shaped contour.

In particular, in the present embodiment, said top profile is formed by a first central circular arc 14*a* and by two second symmetrical lateral circular arcs 14*b*.

The base 10 further has a second recess 15, which lies along a second transverse reference dimension, a second diameter, which is perpendicular to the first diameter.

The second recess 15 is adapted to provide a second auxiliary rib 16.

The top profile of the second auxiliary rib 16 is formed substantially by two symmetrical concavities 16*a* and 16*b*, which lie in a radial direction.

Figure 12:
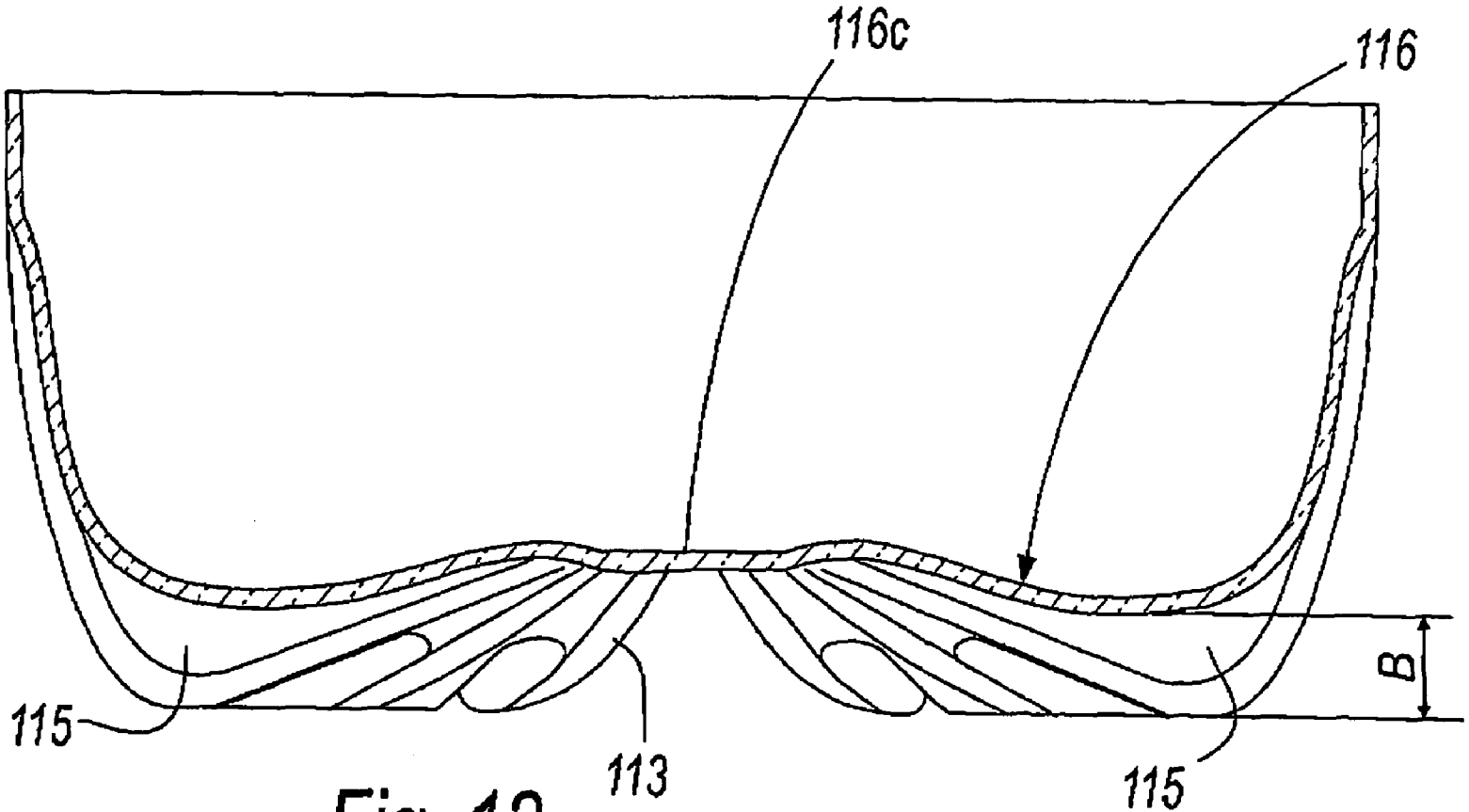
Figure 13:
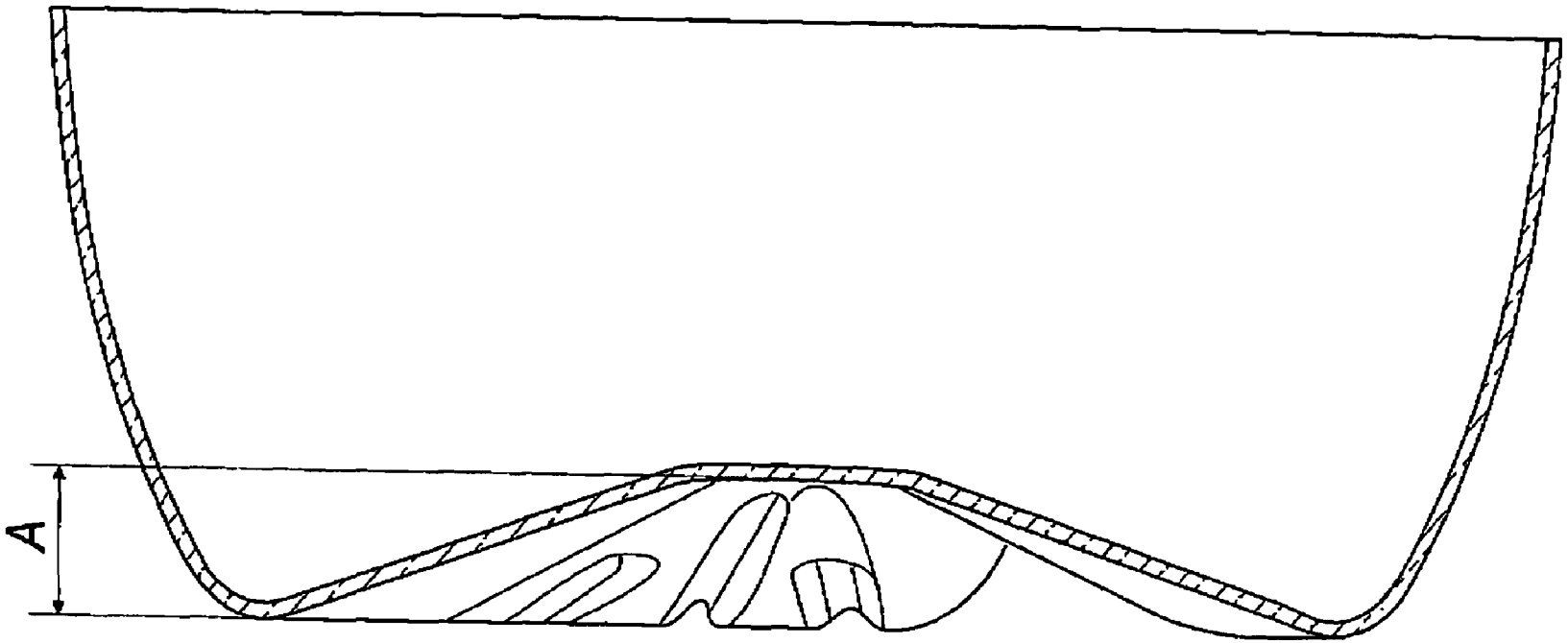

The concavities 16*a* and 16*b* are mutually connected centrally by a third concavity 16*c* around the center 17, which is clearly visible in FIG. 12, where it is designated by the reference numeral 116*c*.

Additional lateral concavities 16*d* and 16*e* are further provided in the regions for connection to a cylindrical body 25 of a bottle 21.

The first and second ribs 14 and 16 are symmetrical with respect to the longitudinal axis of the bottle 21 and intersect in the center 17 of the bottle 11, so that the lowest point 18 of the top profile of the first rib 14, i.e., the one that lies closest to the supporting surface 19 for the first rib 14, is interposed between the two additional lowest points 20 of the top profile of the second rib 16.

The distance A between the supporting surface 19 and the lowest point 18 of the first rib 14 is greater than the distance B between each of the additional lowest points 20 of the second rib 16 and the supporting surface 19.

The reinforcement recesses also comprise third recesses 22.

In the exemplary embodiment described here, the third recesses 22 lie along additional diameters symmetrically in a substantially radial direction.

In a constructive variation of the invention, not shown here for the sake of simplicity, said third recesses can lie in directions other than the radial one.

In the first embodiment described here, said additional diameters are six and are distributed symmetrically between the first rib 14 and the second rib 16.

The additional recesses 22 are adapted to provide corresponding ribs 23, which have a longitudinal cross-section shaped substantially so as to form two concavities, or W-shaped, and strengthen the bottom portions 12 comprised between the first rib 14 and the second rib 16.

The third ribs 23 have lowest points of the corresponding top profile which lie even closer to the supporting surface 19 with respect to the second rib 16.

A bottle base 10 as described here has a larger standing contact surface than bases provided with a known type of petaloid bottom and at the same time withstands a pressure inside the bottle up to one nominal bar.

The base 10 therefore is integrated advantageously with bottles suitable to contain both still nitrogen-capped beverages and slightly sparkling beverages.

These properties of resistance to pressure and larger contact surface are more substantially but not exclusively evident when the following proportions are used.

Figure 2:
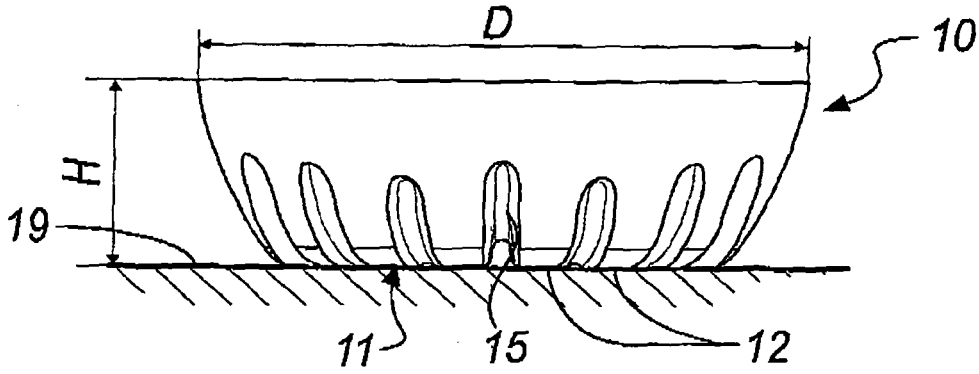
FIG. 2 is a side view of a base according to the invention.
Figure 4:
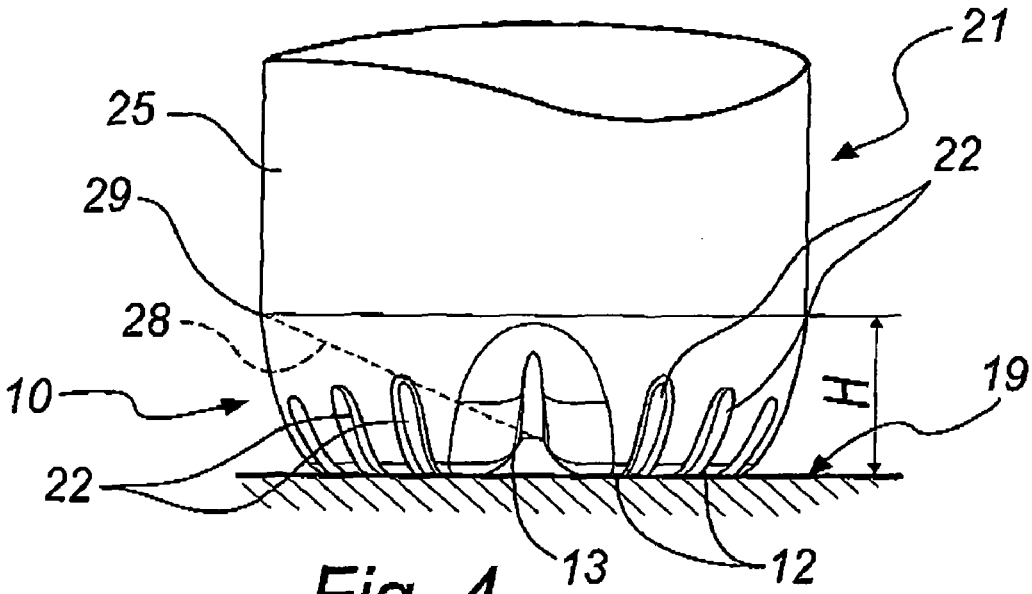
FIG. 4 is an additional side view of a bottle base according to the invention.
Figure 7:
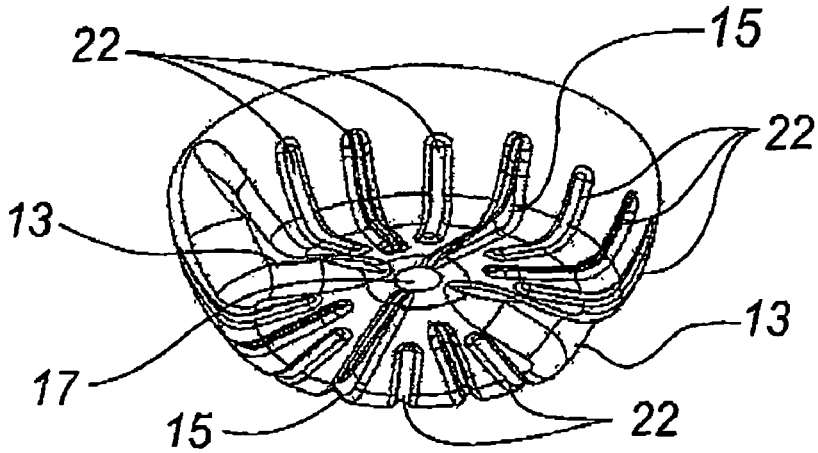
FIG. 7 is a bottom perspective view of a bottle base according to the invention in the first embodiment shown in FIGS. 1 to 6.
Figure 5:
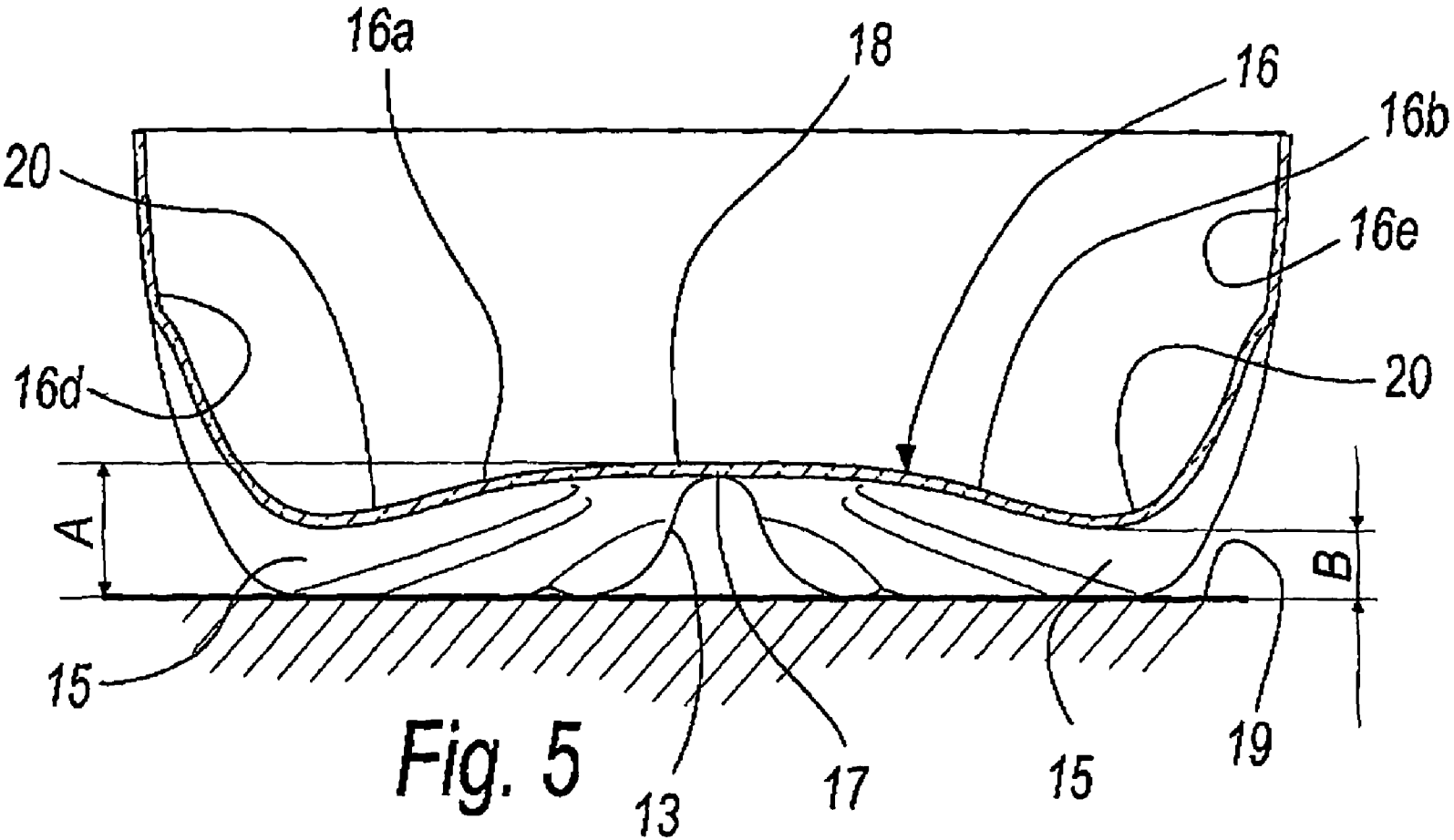
FIG. 5 is a sectional view, taken along the line V-V of FIG. 1.
Figure 6:
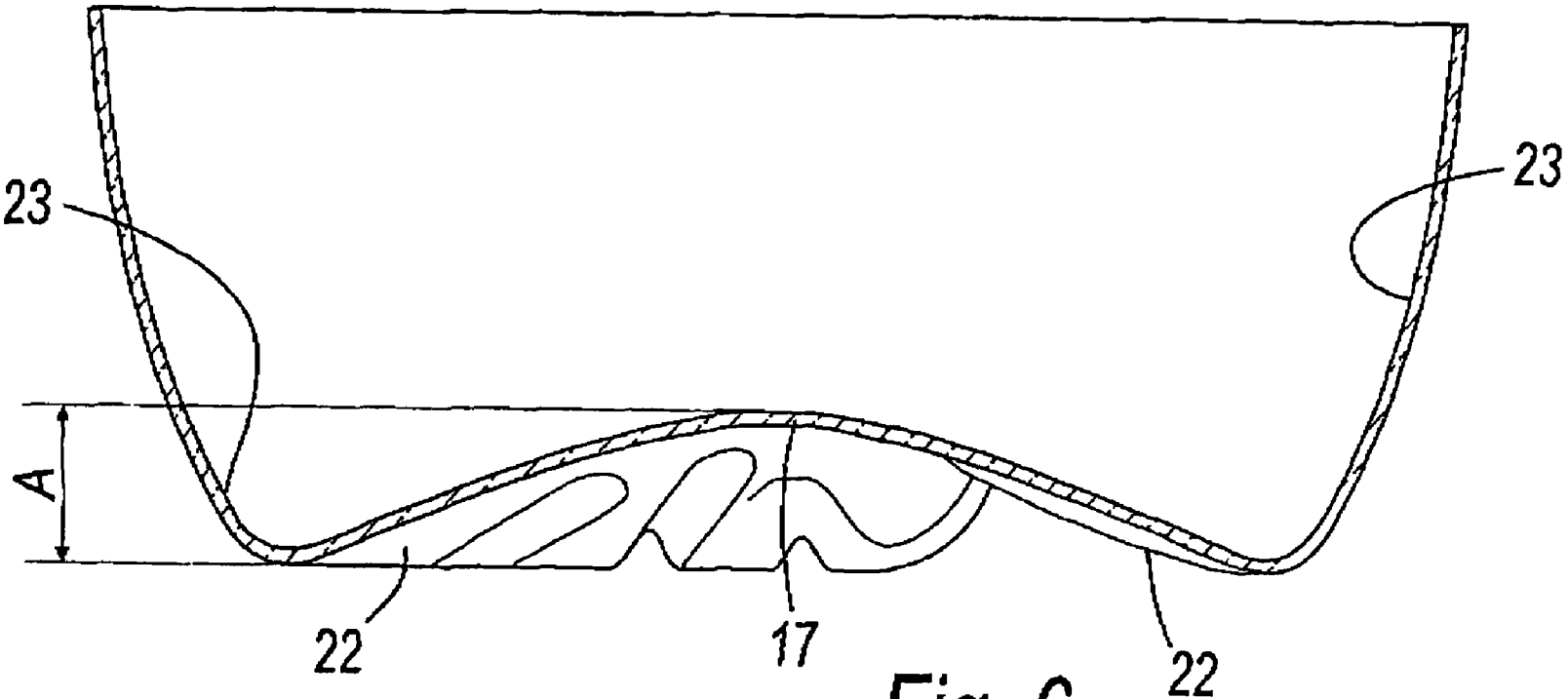
FIG. 6 is a sectional view, taken along the line VI-VI of FIG. 1.
Figure 8:
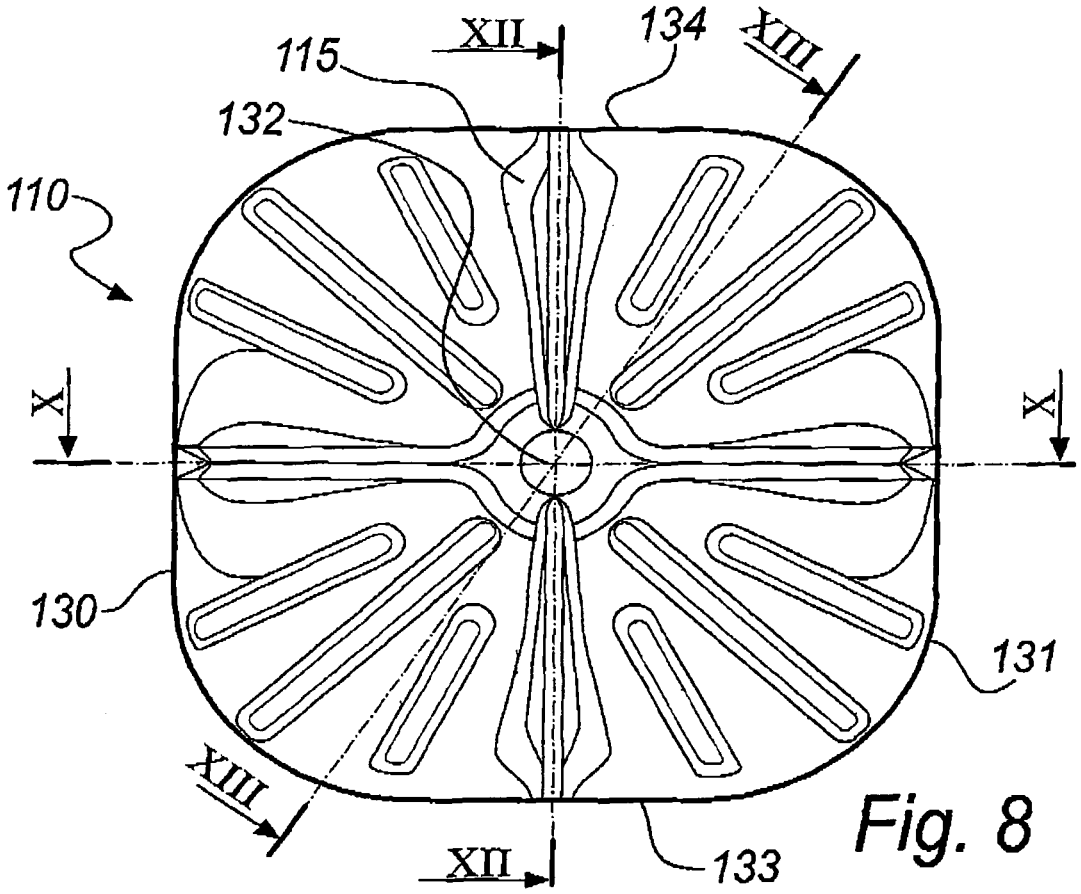
FIGS. 8 to 14 illustrate a bottle base according to the invention in a second embodiment.
Figure 9:
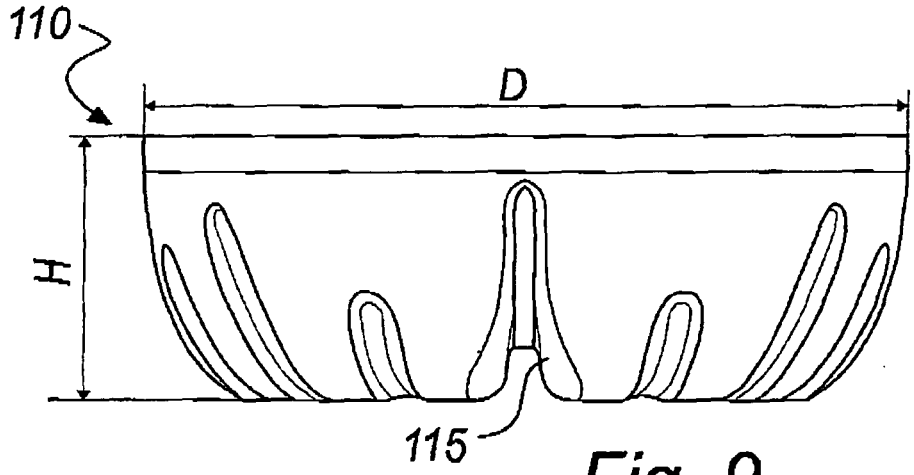

The height of the base 10, designated by the reference letter H in FIGS. 2 and 4, where it is measured between the supporting surface 19 and the connecting point 29 between the base 10 and the cylindrical body 25 of the bottle 21 to which the base belongs (i.e., the point where the main rib 14 reaches the maximum diameter D of the base 10), is comprised between 0.25 times and 0.5 times the maximum transverse reference dimension D of the base 10.

Said distance D, in the first embodiment described so far, is the maximum diameter of the base 10.

Even more advantageously, the height H of the base 10 is comprised between 0.33 times and 0.4 times the maximum transverse reference dimension D of the base 10.

Moreover, the distance A must be comprised between one fifth and one third of said height H.

Greater advantages are obtained from a base 10 in which the distance A is comprised between 0.23 and 0.26 times said height H.

Figure 3:
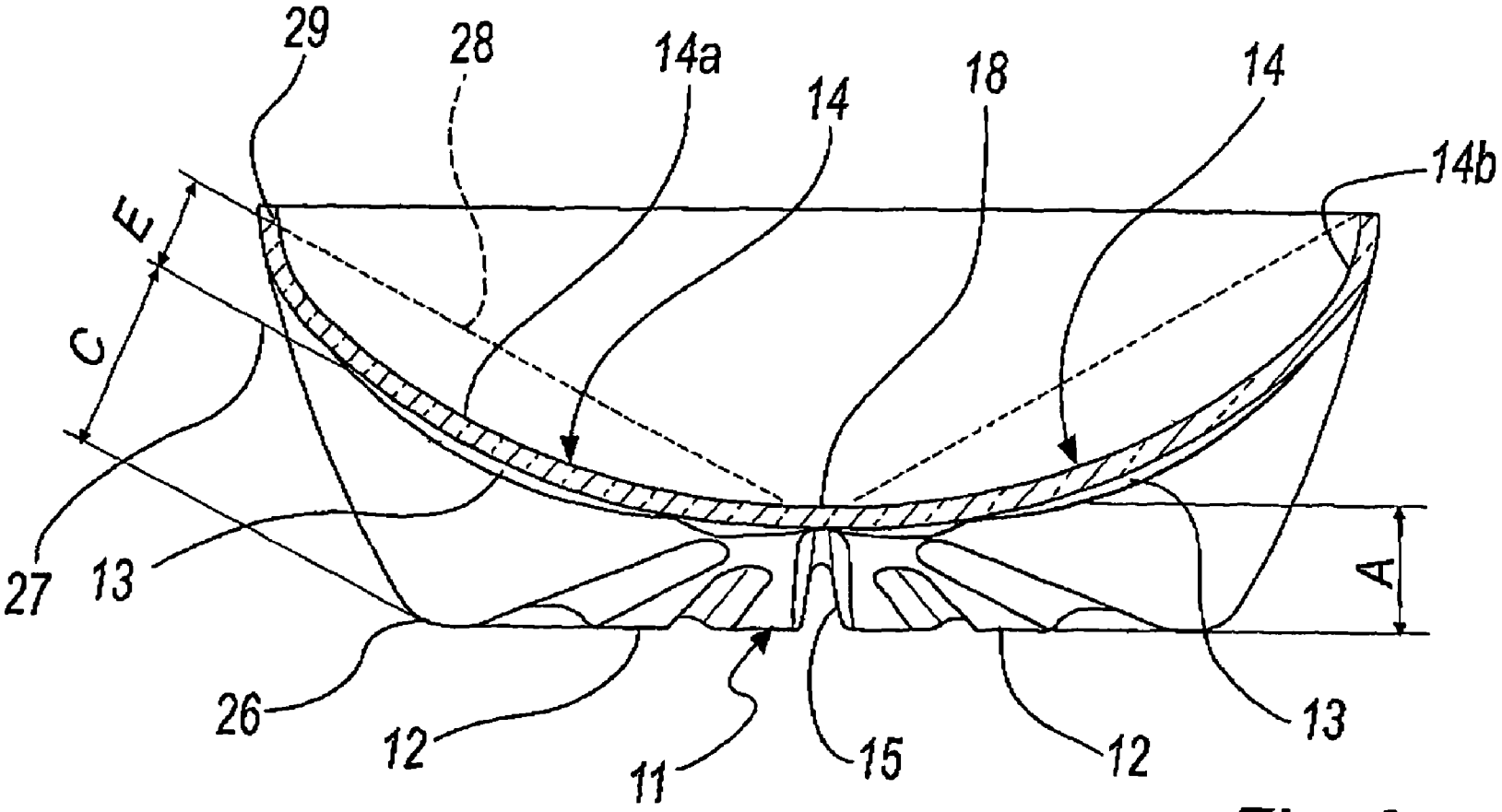
FIG. 3 is a sectional view, taken along the line III-III of FIG. 1.

On a longitudinal cross-section of the base 10, shown in FIG. 3, the reference letter C designates the maximum distance between a point 26 of the external circumference of the bottom 11 and the tangent 27 to the top profile of the first rib 14, at right angles to the tangent 27, and the reference letter E designates the maximum distance between the segment 28, which connects the connecting point 29 between the base 10 of the body 25 (which in this case is cylindrical) to the center 17, and a straight line which is parallel to the segment 28 and tangent to the first rib 14, at right angles to the segment 28.

The maximum distance C is comprised between 1 and 4 times the maximum distance E.

Advantageously, the maximum distance C is comprised between 1.5 and 2 times the maximum distance E.

Another relation to be maintained among the significant dimensions of the base 10 is that the distance B must be shorter than the maximum distance C.

Conveniently, the distance B is comprised between one third and one half of the maximum distance C.

In a second embodiment of the invention, the bottle base has a substantially quadrilateral transverse cross-section.

By way of non-limiting example, in FIGS. 8 to 14 the bottle base 110 according to the invention has a substantially square transverse cross-section.

In this second embodiment, therefore, the transverse reference dimension is a central segment, which is perpendicular to one side of the square cross-section and extends from a first side 130 or 133 to an opposite second side 131 or 134, passing through the center 132.

Also in this second embodiment, the distances A, B, C, D, E and H keep the same meaning that they have in the first embodiment of the invention described above.

The first rib 114, formed with the first recess 113, lies on a first central segment.

Figure 10:
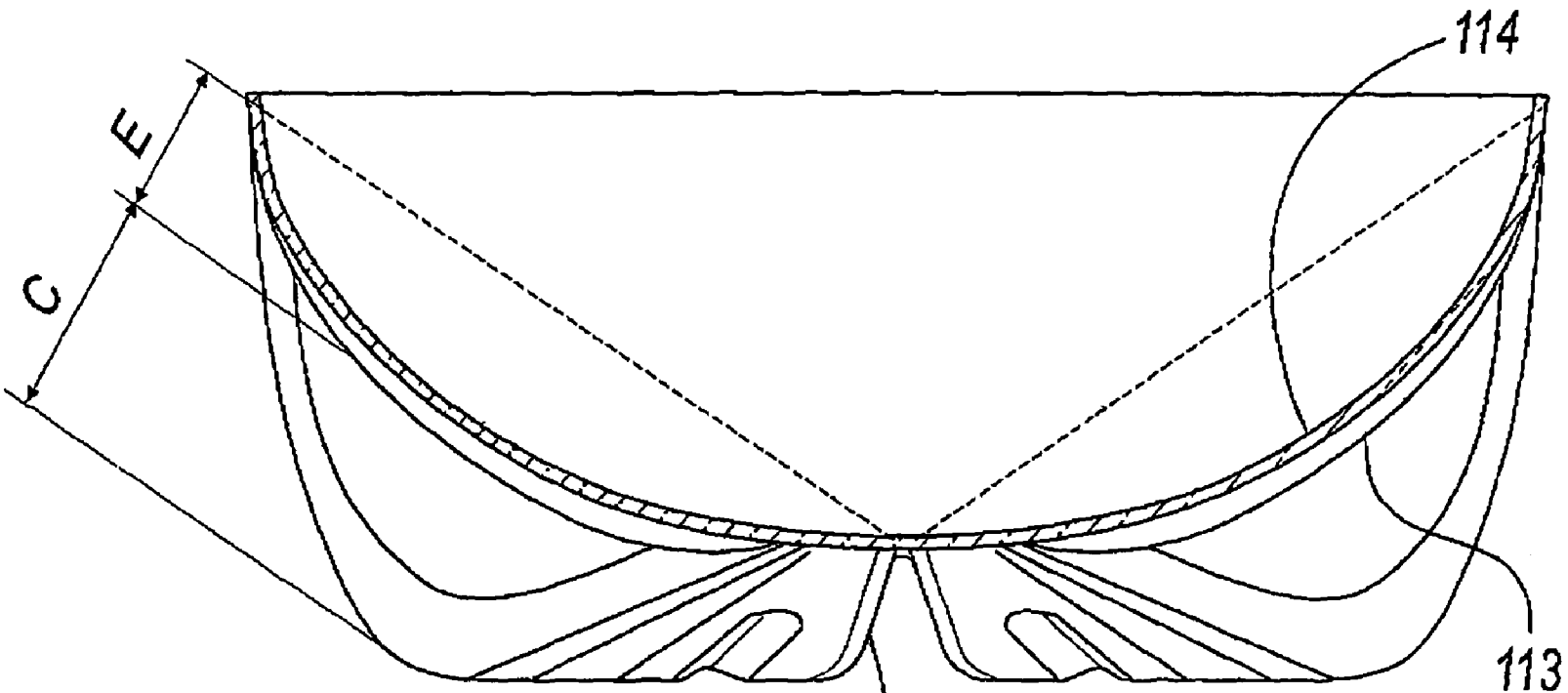
Figure 11:
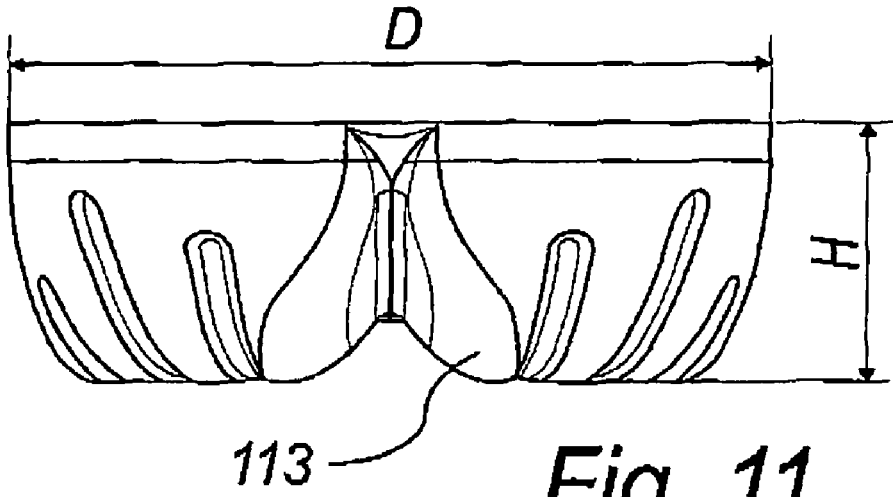
Figure 14:
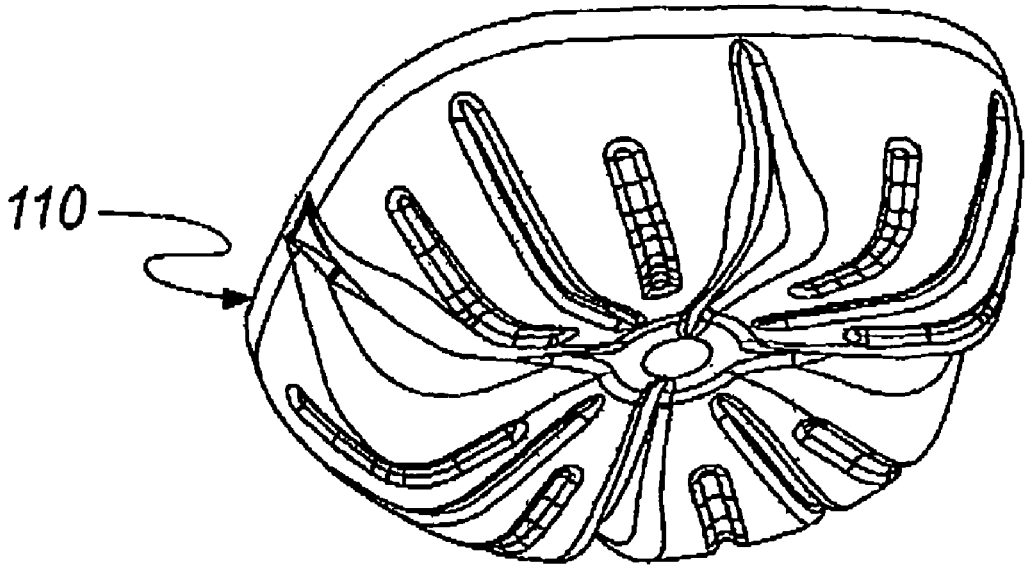

The central line X-X on which said first central segment lies is the one on which the cross-section of FIG. 10 is obtained.

The second rib 116, in a manner similar to the first embodiment, is formed by means of the second recess 115 and lies on a second central segment which is perpendicular to the first one.

The central line XII-XII on which said second central segment lies is the one along which the cross-section of FIG. 12 is taken.

A bottle having a substantially square transverse cross-section and provided with a base 110 according to the invention combines the qualities of optimization of storage volumes with the properties of improved stability and of being no less resistant to internal pressure than known types.

In practice it has been found that the invention thus described solves the problems noted in known types of plastic bottle base, particularly for beverages.

In particular, the present invention provides a bottle base which is capable of withstanding the internal pressures produced by sparkling beverages no less than the bases of known bottles and at the same time is capable of improving the standing stability of the bottle to which it belongs.

Moreover, the present invention provides a bottle base whose aesthetic impact is not lower than that of known types of base.

Further, the present invention provides a bottle base which is capable of withstanding the stresses imparted by the overlying bottles during storage no less than known bottle bases.

Moreover, the present invention provides a bottle base which can be obtained easily and cheaply by molding plastic material.

Further, the present invention provides a bottle base which can be manufactured with known systems and technologies.

The invention thus conceived is susceptible of numerous modifications and variations, all of which are within the scope of the appended claims; all the details may further be replaced with other technically equivalent elements.

In practice, the materials employed, so long as they are compatible with the specific use, as well as the dimensions, may be any according to requirements and to the state of the art.

The disclosures in Italian Patent Application No. PD2004A000323, from which this application claims priority, are incorporated herein by reference.

The invention claimed is:

1. A bottle base made of plastic material and having a bottom and a supporting surface, particularly for beverages, of the type which has, on said bottom, reinforcement recesses, said reinforcement recesses being formed by a first recess which runs along a first transverse reference dimension of the bottle base, said first recess being adapted to form a first main rib inside the base, the bottle base comprising a second recess, which lies along a second transverse reference dimension, substantially perpendicular to the first transverse dimension along which said first main rib lies, said second recess being suitable to provide a second auxiliary rib, a distance between the supporting surface and at least one lowest point of the first main rib being greater than a distance between at least one lowest point of said second auxiliary rib and said supporting surface.

2. The bottle base of claim 1, wherein a top profile of said first main rib is substantially U-shaped.

3. The bottle base of claim 2, wherein the top profile of said first main rib is composed selectively of a circular arc, a combination of circular arcs, a combination of segments, or a combination of at least one circular arc and segments.

4. The bottle base of claim 3, wherein a top profile of said second auxiliary rib is formed substantially by two concavities which are symmetrical and lie radially and are mutually connected centrally by a third concavity in the vicinity of the center and connected to a cylindrical body of the bottle by lateral concavities.

5. The bottle base of claim 4, wherein said first main rib and said second auxiliary rib are symmetrical with respect to a longitudinal axis of said bottle and intersect at a center, or in the vicinity thereof, of said bottom, so that a lowest point of the top profile of said first main rib or the one that lies closest to the supporting surface for said first main rib is interposed between two additional lowest points of the top profile of said second auxiliary rib, a distance between said supporting surface and a minimum point of the first main rib being greater than a distance between each one of said additional lowest points of said second auxiliary rib and said supporting surface.

6. The bottle base of claim 1, wherein said reinforcement recesses further comprise additional recesses, which are adapted to form corresponding strengthening ribs for the bottom portions comprised between said first main rib and said second auxiliary rib.

7. The bottle base of claim 6, wherein said additional recesses lie along a substantially radial direction.

8. The bottle base of claim 7, wherein a top profile of said additional recesses has a substantially W-shaped longitudinal cross-section.

9. The bottle base of claim 4, wherein a height of the base, measured between the supporting surface and a connecting point between said base and a cylindrical body of the bottle to which it belongs, is comprised between 0.25 and 0.5 times a maximum transverse reference dimension of said base.

10. The bottle base of claim 9, wherein the height of the base, measured between the supporting surface and the connecting point between said base and the cylindrical body of the bottle of which said base is part is comprised between 0.33 and 0.4 times the maximum transverse reference dimension of said base.

11. The bottle base of claim 10, wherein said distance is comprised between one fifth and one third of said height.

12. The bottle base of claim 11, wherein said distance is comprised between 0.23 and 0.26 times the height.

13. The bottle base of claim 2, wherein on a longitudinal cross-section of said base, a maximum distance between a point of the outer circumference of the bottom and a tangent to the top profile of the first main rib, which is substantially U-shaped, in the direction at right angles to said tangent, is comprised between one and four times an additional maximum distance between a segment which connects a connecting point between said base and the cylindrical body to said center, and a straight line which is parallel to said segment and is tangent to said first main rib, at right angles to said segment.

14. The bottle base of claim 13, wherein said maximum distance is comprised between 1.5 and two times said additional maximum distance.

15. The bottle base of claim 13, wherein said additional maximum distance is shorter than said maximum distance.

16. The bottle base of claim 15, wherein said additional maximum distance is comprised between one third and one half of said maximum distance.

17. The bottle base of claim 9, having a substantially circular transverse cross-section, said transverse reference dimension being a diameter.

18. The bottle base of claim 9, having a substantially quadrilateral transverse cross-section, said transverse reference dimension being a segment which is perpendicular to one side of said quadrilateral cross-section and runs from a first side to an opposite second side, passing through a center.

19. The bottle base of claim 18, wherein said substantially quadrilateral cross-section is square.

* * * * *